US006786129B2

(12) United States Patent
Ando

(10) Patent No.: US 6,786,129 B2
(45) Date of Patent: Sep. 7, 2004

(54) SENSOR FOR CYLINDER CONTROL, AND CYLINDER DEVICE INCORPORATING THE SAME

(75) Inventor: Etuo Ando, Tokyo (JP)

(73) Assignee: Ando Seisakujo Co., Ltd., Tokyo (JP)

( * ) Notice: Subject to any disclaimer, the term of this patent is extended or adjusted under 35 U.S.C. 154(b) by 0 days.

(21) Appl. No.: 09/964,522

(22) Filed: Sep. 28, 2001

(65) Prior Publication Data

US 2002/0040636 A1 Apr. 11, 2002

(30) Foreign Application Priority Data

Oct. 6, 2000 (JP) ..... 2000-308374
May 15, 2001 (JP) ..... 2001-145329

(51) Int. Cl.[7] ..... F01L 25/02

(52) U.S. Cl. ..... 91/318; 91/421; 91/433; 91/435

(58) Field of Search ..... 91/1, 318, 392, 91/394, 421, 433, 435

(56) References Cited

U.S. PATENT DOCUMENTS 3,541,925 A 11/1970 Guinot
3,691,902 A * 9/1972 Lebzelter ..... 91/1
3,895,560 A * 7/1975 Anderson ..... 91/1
4,002,103 A * 1/1977 Martin ..... 91/1
5,311,808 A * 5/1994 Ando ..... 91/392

FOREIGN PATENT DOCUMENTS

| | | |
|---|---|---|
| DE | 199 55 270 | 5/2001 |
| JP | 6-50304 | 2/1994 |
| JP | 11-10692 | 1/1999 |

* cited by examiner

*Primary Examiner*—F. Daniel Lopez
(74) *Attorney, Agent, or Firm*—Nixon & Vanderhye PC

(57) ABSTRACT

In the present invention, sensors for cylinder control are connected to a main cylinder which has an internal cylinder chamber which is partitioned by a piston into two chambers, and they detect the operational state of the piston. There are provided accumulators connected to one of said two chambers by connecting conduits and whose interiors are pressurized by hydraulic fluid which is expelled from said one chamber, and also stop signal generation mechanisms which generate signals to stop the driving of said main cylinder by pressure differential between said accumulators and said connecting conduits generated at the instant that increase of pressure from said one chamber stops.

10 Claims, 11 Drawing Sheets

SENSOR FOR CYLINDER CONTROL, AND CYLINDER DEVICE INCORPORATING THE SAME

BACKGROUND OF THE INVENTION

1. Field of the Invention

The present invention relates to a sensor for cylinder control which is capable of detecting the operational state of a piston of a cylinder, for example of detecting that the piston has reached the end of its stroke, and to a cylinder device which incorporates such a sensor.

2. Description of the Related Art

Generally a large number of hydraulic cylinders are employed in machines which manufacture automobile parts and the like by metal or plastic casting using metal molding. Recently, in response to greater demands for accurate control of the forward and reverse stroke of such reciprocating cylinders used in production machinery for casting or the like, the machine operation has become more and more automated by the provision of sequence circuitry.

For example, as a prior art technique for cylinder control, as shown in FIG. 12, there is a control technique in which, by a limit switch device 2 which employs an analog switch or a contact switch or the like and which is fitted to a cylinder main device 1, the position in the forward and reverse direction is detected, and a signal is despatched to a control board to stop the cylinder via a changeover valve (a solenoid valve). Furthermore, there is a control technique in which a sensor is housed within the cylinder and detects its position in the forward and reverse direction, and alters the stroke adjustment by a pulse signal, converts it into data by a detection device and again despatches the signal to the control board, and stops the cylinder via a changeover valve. Yet further, in Japanese Patent Publication Heisei 7-42965, there is proposed a technique of providing a sub-cylinder which is synchronized with said main cylinder, and of detecting and controlling the position in the forward and reverse direction by adjusting the amount of hydraulic fluid which flows into said sub-cylinder.

However, with these prior arts of cylinder control, the following problems still remain. In detail, in the case of a prior art limit switch device, the limit switch can easily suffer damage due to high temperature, large quantities of mold release agent or sludge, and it may happen that trouble with metal molds caused by this type of problem can be a great obstruction to production. Furthermore, since the tip portion is installed in the workplace, electrical leakage can easily happen even if waterproof type switches are employed because water, oil, and flash regularly impact thereon, and also there is the danger that the cables to the limit switch device may be cut. Yet further, along with the fact that it may be the case that no space is available to fit the limit switch device within the cylinder main body, also high precision adjustment of the limit switch device according to the size of the cylinder (according to its stroke) may be required. Moreover, if a plurality of cylinders are present, it is necessary to fit an individual limit switch device for each cylinder, and, along with inviting increase in the number of parts and high cost, there is the inconvenience that, if all of the cylinders are controlled using one circuit, this control becomes difficult because it becomes more complicated.

Also, if the sensors are housed internally, since pulse signals are employed, along with the requirements to adjust the drive section inside the cylinder in accordance with the cylinder stroke and to connect it to detectors, there is also a danger of erroneous operation being caused due to the magnetic field which is generated being weak.

Yet further, if control is performed according to the amount of hydraulic fluid which flows into a sub-cylinder, along with the necessity for a blocking member in the main cylinder, it is also necessary to adjust the amount of fluid which flows in. Accordingly there has been felt the desirability of providing a technique which utilizes a more simple structure and which also makes it unnecessary to adjust the amount of hydraulic fluid.

BRIEF SUMMARY OF THE INVENTION

The present invention has been conceived in consideration of the above described problems, and its objective is to provide a sensor for cylinder control and a cylinder device incorporating the same, which avoid the occurrence of erroneous operation due to the possibility of connections coming off from the cylinder, and which can make it unnecessary to perform adjustments according to the size of the cylinder, or to adjust the quantity of fluid.

The present invention uses the following structure for solving the above described problems. Namely, the sensor for cylinder control of the present invention is connected to a main cylinder having an internal cylinder chamber which is partitioned by a piston into two chambers, and which detects the operational state of said piston, and is characterized by comprising: an accumulator which is connected via a connecting conduit to one of said two chambers and whose interior is pressurized by fluid expelled from said one chamber; and a stop signal generation mechanism which generates a signal which stops the driving of said main cylinder due to pressure differential between said accumulator and said connecting conduit which is generated at the instant that the increase of pressure from said one chamber stops.

With this sensor for cylinder control, since the accumulator is incorporated which is connected via the connecting conduit to one of said two chambers so that its interior is pressurized by hydraulic fluid expelled from said one chamber, thereby the hydraulic fluid which is expelled from the chamber (said one chamber) of the main cylinder by the shifting of the piston flows into the accumulator via the connecting conduit, so that the pressure in the accumulator rises. And immediately before the piston, for example, arrives at the end of its stroke, a high surge pressure is generated, so that the pressure in the accumulator rises. Furthermore, at the instant that the piston arrives at the end of its stroke, the pressure of the hydraulic fluid in the chamber abruptly drops, so that the pressure supplied to the accumulator from the connection conduit abruptly drops. At this time, a pressure differential is caused between the accumulator which is in a high pressure state and the connecting conduit in which the pressure has abruptly dropped.

With the present invention, since there is provided a stop signal generation mechanism which generates a signal for stopping the driving of the main cylinder due to pressure differential between the accumulator and the connecting conduit which is generated at the instant that the increase of pressure from said one chamber stops, therefore the stop signal is generated due to the pressure difference which is generated at the instant that the piston arrives at the end of its stroke, and it is possible to stop the driving of the main cylinder. Accordingly, with the present invention, it is possible to stop the main cylinder reliably and also at high speed, directly before the piston arrives at the end of its stroke.

Furthermore, according to another aspect of the present invention, in this sensor for cylinder control, the technique may be employed of making the stop signal generation mechanism comprise a non-return valve provided in the connecting conduit which suppresses flow of fluid towards the one chamber, a first branch conduit of which a one end is connected to the connecting conduit between the accumulator and the non-return valve, a second branch conduit of which a one end is connected to the connecting conduit between the one chamber and the non-return valve, and a switch mechanism which is connected to the other end of the first branch conduit and to the other end of the second branch conduit and which generates the signal when the pressure in the first branch conduit becomes higher than the pressure in the second branch conduit.

With this sensor for cylinder control, due to the pressure differential which is generated at the instant when for example the piston reaches the end of its stroke, although an attempt is made to expel the hydraulic fluid from the accumulator towards the connecting conduit and the first branch conduit, because the non-return valve is present, therefore the fluid only flows to the side of the first branch conduit. Furthermore, the pressure in the first branch conduit becomes greater than the pressure in the second branch conduit, because the pressure in the second branch conduit as well which is connected to the connecting conduit from said one chamber in which the pressure has at the same time abruptly dropped as far as the non-return valve is low. Accordingly, at this time, a signal is generated by the switch mechanism to stop the driving of the main cylinder. In this manner, with the present invention, since a pressure differential is generated between the pressure in the first branch conduit and the pressure in the second branch conduit due to the non-return valve which is provided in the connecting conduit, accordingly it becomes easy for the stop signal to be generated.

Furthermore, according to another aspect of the present invention, in this sensor for cylinder control, it is desirable for the switch mechanism to further include a sensor cylinder which comprises a cylinder chamber which is partitioned by a piston into two chambers, and a switch section which generates the signal mechanically by the shifting of the piston of the sensor cylinder or electrically by a pressure sensor; and one of the chambers of the sensor cylinder is connected with the interior of the first branch conduit, while the other of the chambers of the sensor cylinder is connected with the interior of the second branch conduit.

Since with this sensor for cylinder control, along with connecting the one chamber of the sensor cylinder with the interior of the first branch conduit, also the other of the chambers of the sensor cylinder is connected with the interior of the second branch conduit, therefore, when the pressure in the first branch conduit becomes higher than the pressure in the second branch conduit, it is possible to generate the stop signal by the switch section operating mechanically by the shifting of the piston of the sensor cylinder or electrically by a pressure sensor, and accordingly it is possible to provide reliable operation with a simple and moreover cheap structure.

Furthermore, according to another aspect of the present invention, in this sensor for cylinder control, the technique may be employed of making the stop signal generation mechanism comprise: a non-return valve provided in the connecting conduit which suppresses flow of fluid towards the one chamber; a first branch conduit whose one end is connected to the connecting conduit between the accumulator and the non-return valve; a sensor cylinder which is connected to the other end of the first branch conduit and which comprises a piston which can be shifted by fluid which flows in from the first branch conduit; a switch section which generates the signal mechanically by shifting of the piston of the sensor cylinder or electrically by a pressure sensor; and a shift suppression mechanism which suppresses shifting of the piston of the sensor cylinder against opposition of pressure in the first branch conduit which is lower than the pressure when the pressure differential is generated.

With this sensor for cylinder control, since there is provided the shift suppression mechanism which suppresses shifting of the piston of the sensor cylinder opposing the pressure in the first branch conduit which is lower than the pressure when the pressure differential is generated, accordingly since, while the piston of the main cylinder is shifting, the pressure in the first branch conduit is a lower pressure than the pressure when generating the above described pressure differential, therefore due to the shift suppression mechanism the piston of the sensor cylinder does not shift. And since, when the piston of the main cylinder reaches the end of its stroke, along with the above described pressure differential being generated, also flow of hydraulic fluid into the connecting conduit on the upstream side is suppressed by the non-return valve, accordingly the pressure in the first branch conduit abruptly increases and exceeds the pressure which can be suppressed by the shift suppression mechanism, and the piston of the sensor cylinder shifts and the above described signal is generated by the switch section.

Furthermore, according to another aspect of the present invention, in this sensor for cylinder control, it is desirable for the accumulator to be a synchronizing cylinder comprising a piston which can be shifted by fluid which flows in from the connecting conduit, and to include a load mechanism which applies load to the piston of the synchronizing cylinder to shift it, when fluid flows in from the connecting conduit.

With this sensor for cylinder control, since there is included the load mechanism which applies load to the piston of the synchronizing cylinder to shift it, when fluid flows in from the connecting conduit, therefore, although the piston of the synchronizing cylinder shifts when hydraulic fluid flows into the synchronizing cylinder from the connecting conduit, at this time, load is imposed by the load mechanism, and, along with increasing the pressure within the synchronizing cylinder, the internal volume of the chamber increases. Furthermore, at the instant that the piston of the main cylinder reaches the end of its stroke, when the pressure in the connecting conduit abruptly drops, a pressure differential is generated between the synchronizing cylinder and the connecting conduit, so that hydraulic fluid flows from the synchronizing cylinder to the side of the connecting conduit, and the stop signal for main cylinder driving is generated. In other words, it is possible to ensure a sufficient pressure differential and fluid amount for generating the stop signal.

Furthermore, according to another aspect of the present invention, in this sensor for cylinder control, it is desirable for the accumulator to be a large diameter conduit whose internal diameter is set to be larger than that of the connecting conduit.

With this sensor for cylinder control, since the accumulator is a large diameter conduit whose internal diameter is set to be larger than that of the connecting conduit, therefore the pressure in the interior of the large diameter conduit is increased by the inflow of hydraulic fluid from the connecting conduit, and it is possible to accumulate a great deal of pressure energy therein due to its large internal diameter, so that it is possible to provide the beneficial effect of an accumulator with an extremely simple structure.

Furthermore, according to another aspect of the present invention, in this sensor for cylinder control, it is desirable for the stop signal generation mechanism to comprise an erroneous operation detection mechanism which sets in advance as a normal operating time period the time period until the piston of the main cylinder arrives at the end of its stroke during normal operation and the stop signal is generated, and generates a signal indicative of erroneous operation, when the stop signal for the driving of the main cylinder is generated in a time period which is shorter than the normal operating time period.

With this sensor for cylinder control, since there is included the erroneous operation detection mechanism which generates a signal indicative of erroneous operation, when the stop signal for the driving of the main cylinder is generated in a time period which is shorter than the normal operating time period, therefore if for example in metal mold forming or the like the piston stops at an intermediate point of its travel due to flash or the like, although a pressure differential identical to that during normal operation is generated and the stop signal is generated, in this case it is possible for the erroneous operation detection mechanism to detect that erroneous operation has occurred, since the stop signal has been generated more quickly than the normal operating time period.

Moreover, according to a different aspect of the present invention, a cylinder device according to the present invention comprises a main cylinder comprising an internal cylinder chamber which is partitioned by a piston into two chambers, and is characterized by comprising to a sensor for cylinder control of any of the above described types according to the present invention, which is connected at least one of said two chambers.

With this cylinder device, since a sensor for cylinder control of any of the above described types according to the present invention is provided and is connected at least one of said two chambers, thereby it is possible to stop the driving of the main cylinder reliably and at high speed, since this sensor for cylinder control generates a stop signal at the instant that the piston of the main cylinder arrives at the end of its stroke.

Furthermore, according to another aspect of the present invention, in this cylinder device, it is desirable for there to be further included a pair of supply and drain conduits of which the one ends are connected to the two chambers of the main cylinder and which supply and drain fluid thereto and therefrom, and a changeover valve which is connected to the other ends of the pair of supply and drain conduits, and for the sensor for cylinder control to be provided so as to connect the connecting conduit to at least one of the pair of supply and drain conduits.

With this cylinder device, since the sensor for cylinder control is provided as connecting the connecting conduit to at least one of the pair of supply and drain conduits, thereby it is possible to operate the sensor for cylinder control with the hydraulic fluid which flows into the connecting conduit via the pair of supply and drain conduits which supply and drain fluid to and from the main cylinder to drive it, and it is possible to manage without connecting the connecting conduit directly to the main cylinder, so that it is possible to construct the pipework in a simple manner.

Furthermore, according to another aspect of the present invention, in this cylinder device, it is desirable to provide a plurality of the main cylinders, and to connect the sensor for cylinder control so that the connecting conduit branches to the plurality of main cylinders.

With this cylinder device, since the connecting conduit of the sensor for cylinder control is connected to the plurality of main cylinders by being branched, thereby it is possible, for example, to control a plurality of main cylinders which have different outputs by a single sensor for cylinder control.

Furthermore, according to another aspect of the present invention, in this cylinder device, it is desirable for the sensor for cylinder control to be disposed at the changeover valve. In other words, since with this cylinder device the cylinder control sensor is located at the changeover valve, it is possible to anticipate combination and unification with the changeover valve, and thereby it is possible to make the entire system more compact and to reduce its cost.

DETAILED DESCRIPTION OF THE INVENTION

Figure 1:
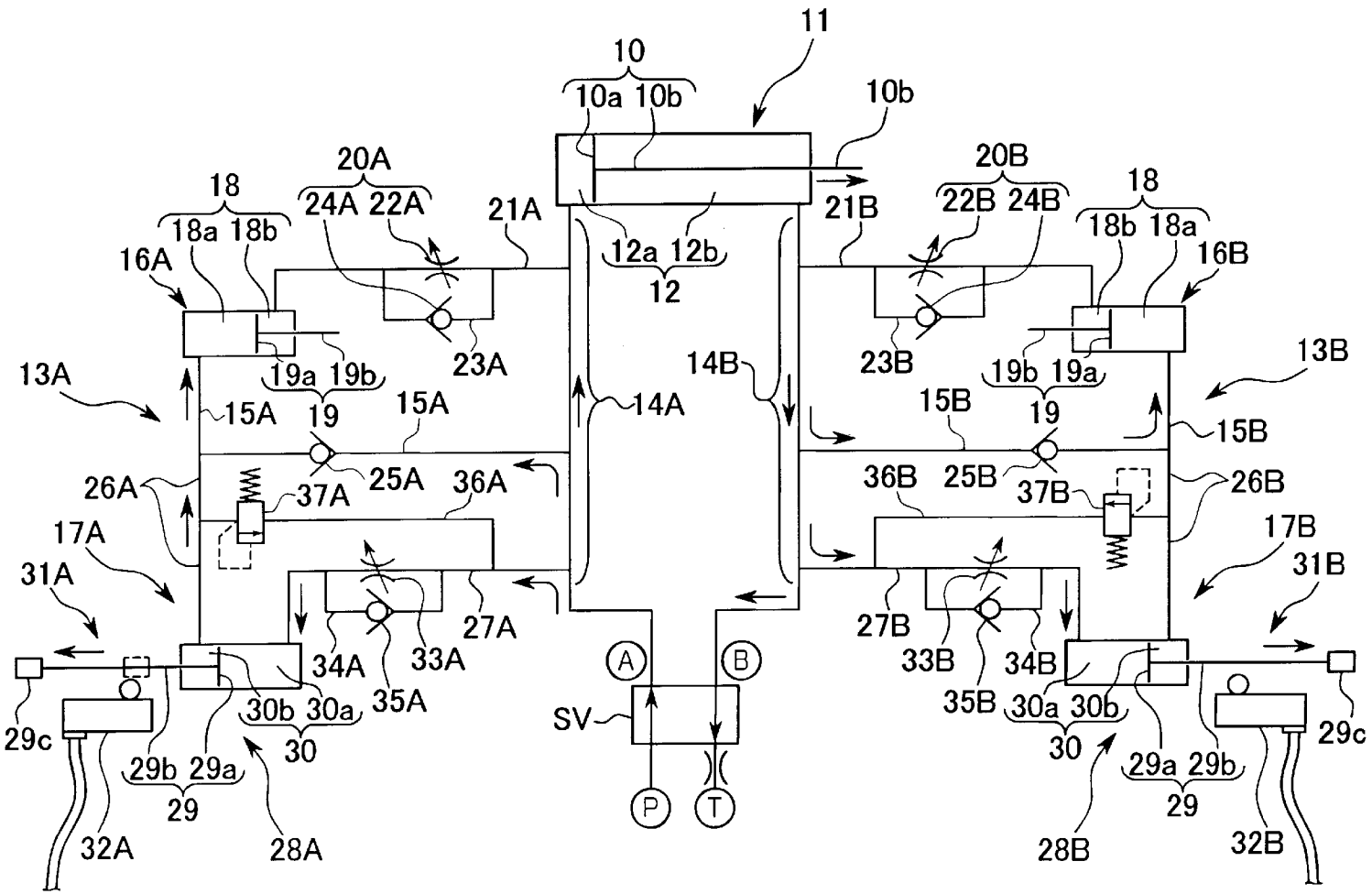
FIG. 1 is a circuit diagram of a sensor for cylinder control and a cylinder device which incorporates the same according to a first preferred embodiment of the present invention, showing the circuit state at the instant that the piston commences its forward motion.

In the following a first preferred embodiment of the sensor for cylinder control according to the present invention and a first preferred embodiment of the cylinder device according to the present invention which embodies said sensor will be explained with reference to FIGS. 1 through 7. In these figures the reference numeral 11 denotes a main cylinder, while 13A denotes a first sensor for cylinder control and 13B denotes a second sensor for cylinder control.

As shown in FIGS. 1 through 5, the cylinder device of this first preferred embodiment comprises a large size main cylinder 11 which is a core cylinder formed by casting in a metal mold or a bored cylinder having an internal cylinder chamber 12 which is partitioned by a piston 10 into two chambers, a head side chamber 12*a* and a rod side chamber 12*b*, and a first sensor for cylinder control 13A and a second sensor for cylinder control 13B which are connected to said two chambers 12*a* and 12*b* of this main cylinder 11.

A piston 10 is inserted into the cylinder chamber 12 of the above mentioned main cylinder 11 so as to be axially slidable therein. This piston 10 is comprised of a large diameter piston portion 10*a* which partitions the cylinder chamber 12 into the above mentioned two chambers, i.e. the head side chamber 12*a* and the rod side chamber 12*b*, and a rod portion 10*b* of which one end is fixed to the center of one side of said piston portion 10*a* and the other end projects outwards from the cylinder chamber 12.

Furthermore the one ends of a pair of supply and drain conduits 14A and 14B are connected to the head side chamber 12*a* and the rod side chamber 12*b* of the main cylinder 11, so as to supply and drain fluid such as hydraulic fluid to and from these chambers 12*a* and 12*b*, in other words so as to supply fluid to them and to exhaust fluid from them. The other ends of these supply and drain conduits 14A and 14B are connected to a changeover valve SV, and a pump P which ejects pressurized fluid and a tank T in which drained fluid is stored are also connected to said changeover valve SV.

In detail, the changeover valve SV is a solenoid valve which changes over the connections of the pump P and the tank T to the pair of supply and drain conduits 14A and 14B, and by this changing over action, on the one hand one or the other of the supply and drain conduits 14A and 14B is connected to the side of the pump P so as to be supplied with hydraulic fluid at high pressure, while on the other hand the other of said conduits 14A and 14B is connected to the side of the tank T so as be at low pressure; and, as a result, one or the other of the rod side chamber 12*b* and the head side chamber 12*a* is connected to the pump P and receives hydraulic fluid at high pressure therefrom, while the other thereof is connected to the tank T which drains the returning hydraulic fluid therefrom.

Figure 5:
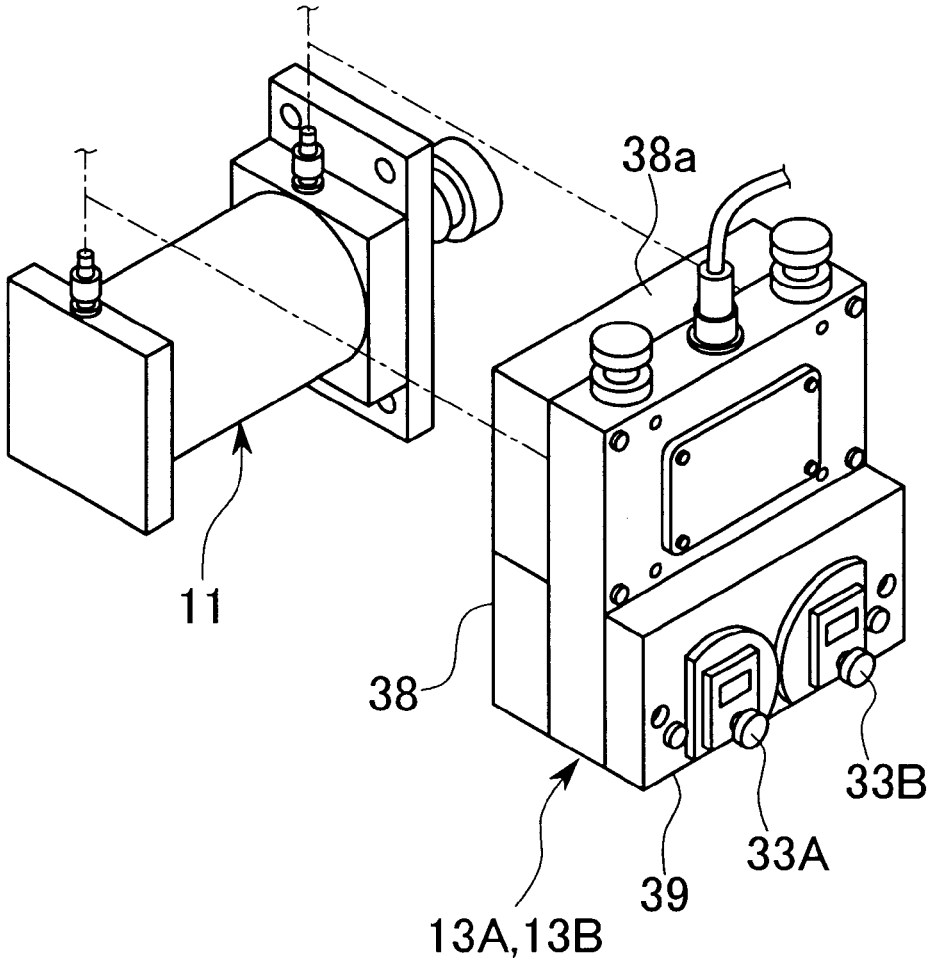
FIG. 5 is a perspective view showing the first preferred embodiments of the sensor for cylinder control and the cylinder device which incorporates the same according to the first preferred embodiment of the present invention.

As shown in FIG. 5, the above mentioned first and second sensors for cylinder control 13A and 13B are positioned at positions far from the main cylinder 11, as for example upon a control board, and are connected via first connecting conduits 15A and 15B to the supply and drain conduits 14A and 14B. It should be understood that the first and second sensors for cylinder control 13A and 13B of this first preferred embodiment are provided on the side of the changeover valve SV and are installed as an integrated valve.

Furthermore, the first and second sensors for cylinder control 13A and 13B comprise synchronizing cylinders (accumulators) 16A and 16B which are connected via the first connecting conduits 15A and 15B to the supply and drain conduits 14A and 14B and are internally pressured by hydraulic fluid which is expelled from the head side chamber 12*a* or the rod side chamber 12*b*, and stop signal generation mechanisms 17A and 17B which generate signals for stopping the driving of the main cylinder 11 upon pressure differential between the synchronizing cylinders 16A and 16B and the first connecting conduits 15A and 15B instantaneously generated by additional pressure from the head side chamber 12*a* or the rod side chamber 12*b* being stopped.

Moreover, the synchronizing cylinder 16A of the first sensor for cylinder control 13A is connected to the supply and drain conduit 14A which is connected to the head side chamber 12*a* of the main cylinder 11, while the synchronizing cylinder 16B of the second sensor for cylinder control 13B is connected to the supply and drain conduit 14B which is connected to the rod side chamber 12*b* of the main cylinder 11.

The above described synchronizing cylinders 16A and 16B are each defined 4 by a piston 19 which is slidably inserted into a cylinder chamber 18. Said piston 19 is comprised of a large diameter piston portion 19*a* which partitions the cylinder chamber 18 into two chambers, i.e. a head side chamber 18*a* and a rod side chamber 18*b*, and a rod portion 19*b* of which the base end is fixed to said piston portion 19*a* and the other end projects to the outside of the cylinder chamber 18.

With the first sensor for cylinder control 13A, the head side chamber 12*a* of the main cylinder 11 and the head side chamber 18*a* of the synchronizing cylinder 16A are connected via the supply and drain conduit 14A and the first connection conduit 15A, and, with the second sensor for cylinder control 13B, the rod side chamber 12*b* of the main cylinder 11 and the head side chamber 18*a* of the synchronizing cylinder 16B are connected via the supply and drain conduit 14B and the first connecting conduit 15B. Furthermore, load mechanisms 20A and 20B are provided to the rod side chambers 18*b* of the synchronizing cylinders 16A and 16B and are subjected to load, when the pistons 19 of the synchronizing cylinders 16A and 16B are shifted towards said rod side chambers 18.

Said load mechanisms 20A and 20B are built so as to function as flow controllers, and are comprised of second connecting conduits 21A and 21B which connect the rod side chambers 18*b* of the synchronizing cylinders 16A and 16B and the main cylinder 11, first throttle valves 22A and 22B (per se conventional throttle valves or orifices (fixed throttle valves) which constitute flow control valves) which are provided in said second connecting conduits 21A and 21, first bypass conduits 23A and 23B which are connected on both sides of said first throttle valves 22A and 22B in the second connecting conduits 21A and 21B, and first non-return valves 24A and 24B provided in said first bypass conduits 23A and 23B which stop the flow of hydraulic fluid from the main cylinder 11 to the synchronizing cylinders 16A and 16B.

Moreover, the second connecting conduit of the first sensor for cylinder control 13A connects together the rod side chamber 18*b* of the synchronizing cylinder 16A and the head side chamber 12*a* of the main cylinder 11, while the second connecting conduit 21B of the second sensor for cylinder control 13B connects together the rod side chamber 18*b* of the synchronizing cylinder 16B and the rod side chamber 12*b* of the main cylinder 11.

The above described stop signal generation mechanisms 17A and 17B are comprised of second non-return valves 25A and 25B provided in the first connecting conduits 15A and 15B which stop the flow of hydraulic fluid towards the main cylinder 11, first branch conduits 26A and 26B of which the one ends are connected to the first connecting conduits 15A and 15B between the synchronizing cylinders 16A and 16B and the second non-return valves 25A and 25B, second branch conduits 27A and 27B of which the one ends are connected to the supply and drain conduits 14A and 14B between the changeover valve SV and the connection points of the first connecting conduits 15A and 15B and which are thus connected to said first connecting conduits 15A and 15B via said supply and drain conduits 14A and 14B, and switch mechanisms 28A and 28B which are connected to the other ends of the first branch conduits 26A and 26B and to the other ends of the second branch conduits 27A and 27B and which generate stop signals when the pressure in the first branch conduits 26A and 26B becomes greater than the pressure in the second branch conduits 27A and 27B.

Said switch mechanisms 28A and 28B are comprised of sensor cylinders 31A and 31B which comprise cylinder chambers 30 which are partitioned by pistons 29 into two chambers, i.e. into head side chambers 30*a* and rod side chambers 30*b*, and switch sections 32A and 32B which generate stop signals mechanically upon shifting of the pistons 29 of said sensor cylinders 31A and 31B.

The above described sensor cylinders 31A and 31B are sub-cylinders which are somewhat smaller than the synchronizing cylinders 16A and 16B, and their pistons 29 are slidably inserted into their cylinder chambers 30. These pistons 29 each comprise a large diameter piston portion 29*a* which partitions the cylinder chamber 30 into two chambers, i.e. a head side chamber 30*a* and a rod side chamber 30*b*, and a rod portion 29*b* whose base end is fixed to said piston portion 29*a* and whose other end protrudes to the outside of the cylinder chamber 30. Furthermore, along with the rod side chambers 30*b* of the sensor cylinders 31A and 31B and the aforesaid other ends of the first branch conduits 26A and 26B being connected together, the head side chambers 30*a* of the sensor cylinders 31A and 31B and the aforesaid other ends of the second branch conduits 27A and 27B are connected together.

The above described switch sections 32A and 32B are micro switches which are positioned on the rod portion 29B sides of the sensor cylinders 31A and 31B, and, when the rod portions 29*b* are pulled into the cylinder chambers 30, these micro switches are changed over from OFF to ON by engagement portions 29*c* which are fixed upon the tip ends of the rod portions 29*b*, and this is shown by display devices which are provided upon control boards 38; and this indicates that the changeover valve SV is changed over from a flow position to a neutral position.

The above described second branch conduits 27A and 27B are comprised of second throttle valves 33A and 33B (per se conventional throttle valves or orifices (flow amount control valves such as fixed throttle valves) or the like), second bypass conduits 34A and 34B which are connected on both the sides of these second throttle valves 33A and 33B in the second branch conduits 27A and 27B, and third non-return valves 35A and 35B which are provided in said second bypass conduits 34A and 34B and which prevent the flow of hydraulic fluid towards the sensor cylinders 31A and 31B from the supply and drain conduits 14A and 14B.

The one ends of third branch conduits 36A and 36B are connected to the first branch conduits 26A and 26B, while the other ends of said third branch conduits 36A and 36B are connected to the second branch conduits 27A and 27B between the points of connection of the second bypass conduits 34A and 34B and their points of connection to the supply and drain conduits 14A and 14B.

At intermediate points along the above described third branch conduits 36A and 36B there are provided relief valves 37A and 37B. When the pressure Win the first branch conduits 26A and 26B rises to a relief pressure level, these relief valves 37A and 37B relieve the hydraulic fluid in said first branch conduits 26A and 26B to the third branch conduits 36A and 36B. It should be noted that the relief valves 37A and 37B may be other types of unit such as pressure adjustment valves, and furthermore they may be non-return valves which can maintain pressure.

Figure 6:
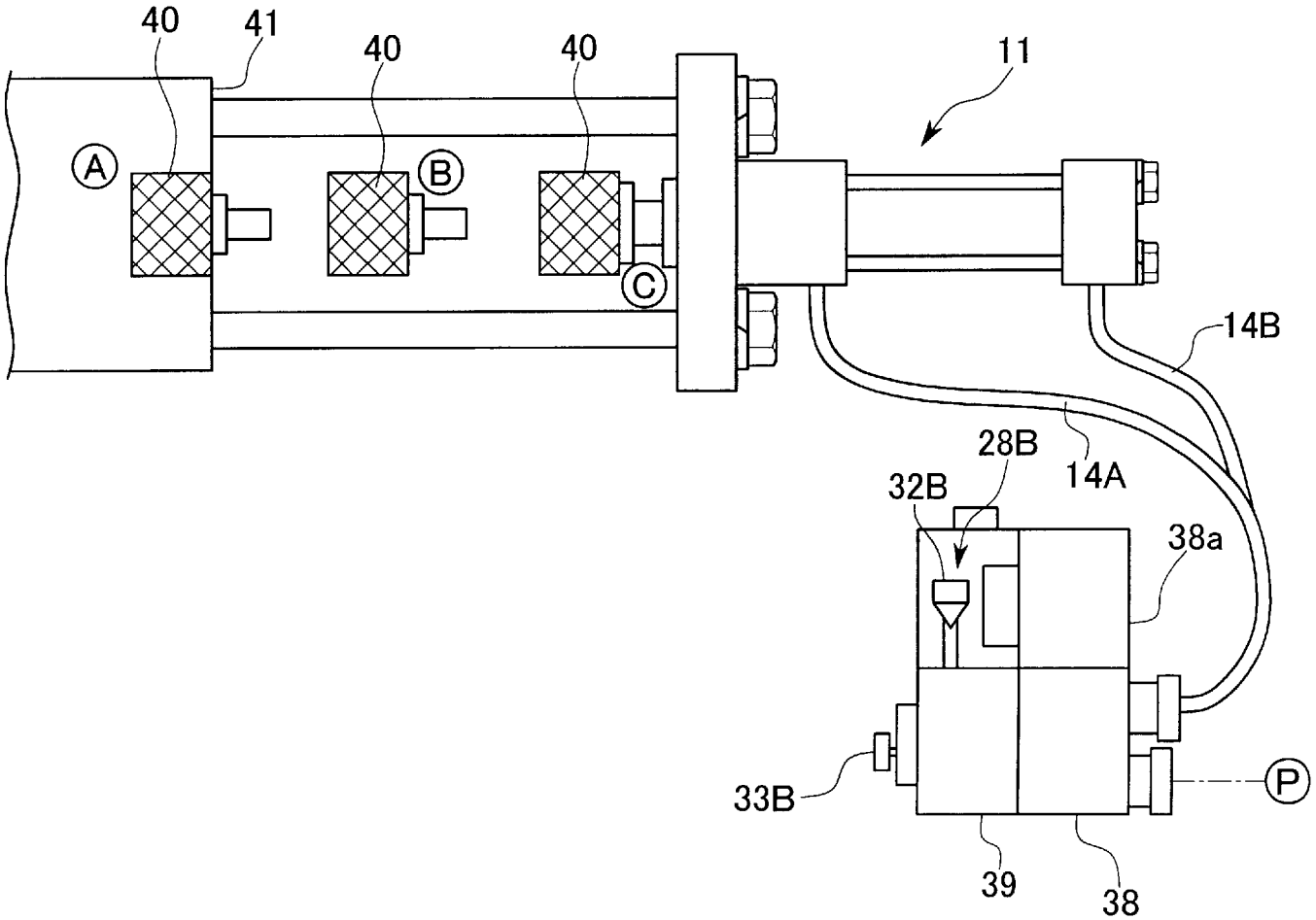
FIG. 6 is a side elevation view showing the first preferred embodiments of the sensor for cylinder control and the cylinder device which incorporates the same according to the first preferred embodiment of the present invention, for explanation of the situation of intermediate stoppage of the piston.
Figure 7:
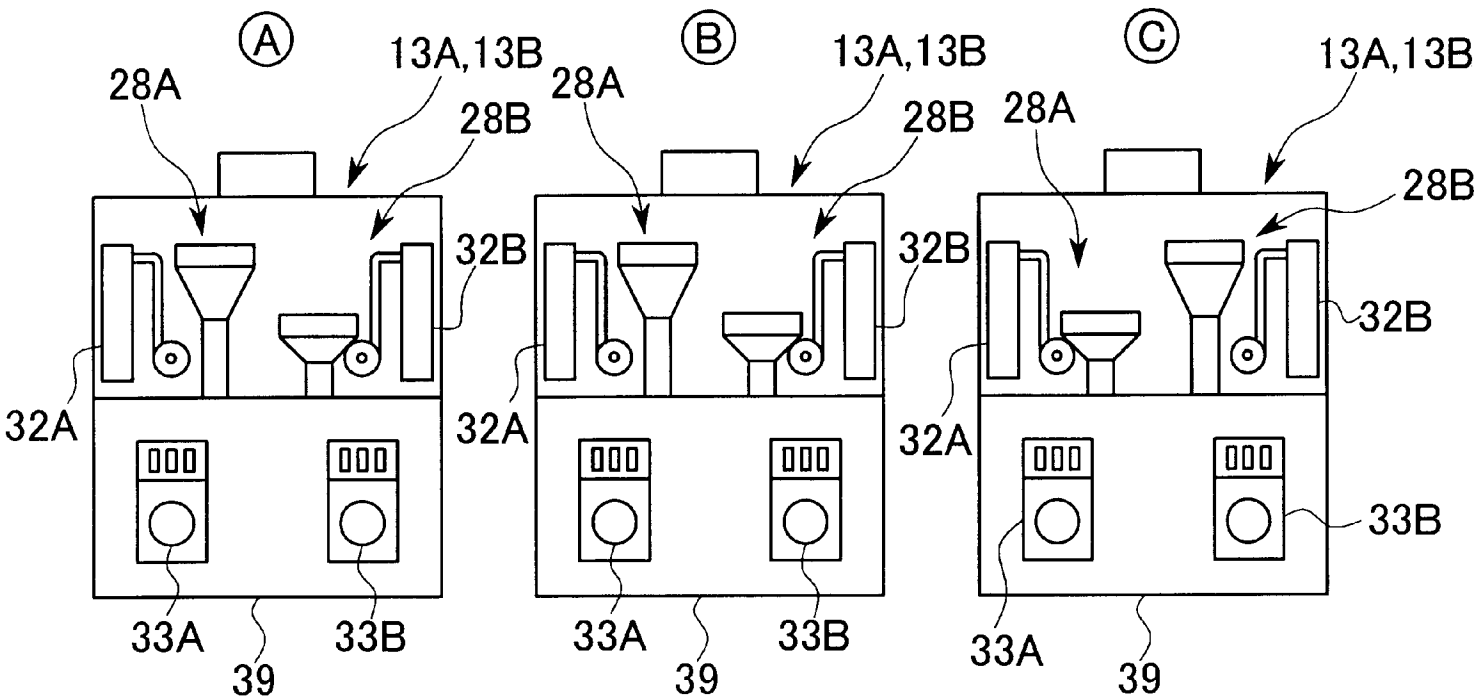
FIG. 7 is an explanatory figure for the first preferred embodiments of the sensor for cylinder control and the cylinder device which incorporates the same according to the first preferred embodiment of the present invention, and shows the states of a switch section of a control board (A) during normal operation, (B) during intermediate stoppage, and (C) before operation.

Furthermore, as shown in FIGS. 6 and 7, the above described stop signal generation mechanisms 17A and 17B set the time period until the piston 10 arrives at the end of its stroke during normal operation and the drive stop signal is generated as the normal operating time period, and comprise a timer (erroneous operation detection mechanism) 38*a* which generates signals that notify of the occurrence of erroneous operation if the stop signal is generated by the driving of the main cylinder 11 coming to a stop in a time period which is shorter than said normal operating time period.

The above describer timer 38*a* is provided upon the control board 38 to which a case 39 which houses the first and second sensors for cylinder control 13A and 13B is installed, and is electrically connected to the switch sections 32A and 32B. This timer 38*a* starts its count from the time point (with the system in the state A in FIG. 7) when the switch section 32A of the first sensor for cylinder control 13A goes into its ON state, and counts up until the switch section 32B of the second sensor for cylinder control 13B goes into its ON state (with the system in the state B or the state C of FIG. 7); and, if the operating time period during this time is shorter than the above described normal operating time period, steps are automatically performed for notifying the operator that an error has occurred such as, for example, sounding a buzzer or flashing a lamp. It should be understood that the above described normal operating time period is inputted to the timer 38*a* and is set therein by supplementing a certain time lag allowance to the operating time period which is required for the piston 10 of the main cylinder 11 to arrive at the end of its stroke under normal conditions.

In the following the method of control of the main cylinder 11 of the cylinder device according to this first preferred embodiment will be explained with reference to FIGS. 1 through 4.

{Start of the Piston Stroke}

First, as shown in FIG. 1, pressurized hydraulic fluid from the pump P is supplied from the port A of the changeover valve SV via the supply and drain conduit 14A to the head side chamber 12*a* of the main cylinder 11. At this time, the hydraulic fluid is forced into the head side chamber 12*a* at high pressure, so that the piston 10 of the main cylinder 11 commences its forward stroke.

Furthermore, a portion of this hydraulic fluid flows into the first connecting conduit 15A of the first sensor for cylinder control 13A. It should be noted that this hydraulic fluid flows predominantly to the side of this first connecting conduit 15A, because of the provision of the first throttle valve 22A and the first non-return valve 24A in the second connecting conduit 21A. And the pressurized hydraulic fluid which flows into the first connecting conduit 15A then flows into the head side chamber 18*a* of the synchronizing cylinder 16A and drives the piston 19 thereof forwards.

Yet further, a portion of the pressurized hydraulic fluid flows into the second branch conduit 27A. At this time the hydraulic fluid flows via the second bypass conduit 34A into the head side chamber 30*a* of the sensor cylinder 31A, but does not flow into the first branch conduit 26A which is connected to the third branch conduit 36A. And the pressurized hydraulic fluid which flows into the sensor cylinder 31A drives the piston 29 of said sensor cylinder 31A forwards, and at the same time the stop portion 29*c* at its end is removed away from the switch section 32A, so that the micro-switch thereof goes into the OFF state.

On the other hand, by the piston 10 of the main cylinder 11 being driven forward, the hydraulic fluid in the rod side chamber 10*b* is expelled through the supply and drain conduit 14B which is connected to said rod side chamber 10*b*, and most of this hydraulic fluid is returned to the tank T from the port B of the changeover valve SV. However, a restriction is provided between the drain conduit 14B and the tank to restrict the flow to the tank so that the pressure in drain conduit 14B is above tank pressure when piston 10 of main cylinder 11 is driven forward. Thus, a portion of the expelled hydraulic fluid flows into the first connecting conduit 15B of the second sensor for cylinder control 13B. It should be understood that the hydraulic fluid preferentially flows to the side of the first connecting conduit 15B, because the first throttle valve 22B and the first non-return valve 24B are provided in the second connecting conduit 21B. And the pressurized hydraulic fluid which flows into the first connecting conduit 15B enters into the head side chamber 18*a* of the synchronizing cylinder 16B and its piston 19 is driven by the pressure caused by forward movement of piston 10 and the restriction provided between the drain conduit 148 and the tank.

At this time, due to the first throttle valve 22B and the first non-return valve 24B which are included in the load mechanism 20B, the load is taken by shifting of the piston 19 of the synchronizing cylinder 16B, and said cylinder 16B functions so as to accumulate pressure energy, and the pressure in the head side chamber 18*a* rises due to inflow of hydraulic fluid from the first connecting conduit 15B pressurized by the pressure in conduit 14B, so that the volume within the chamber increases.

Furthermore, a portion of the pressurized hydraulic fluid also flows into the second branch conduit 27B. At this time the hydraulic fluid does not flow into the first branch conduit 26B which is connected to the third branch conduit 36B, but flows into the head side chamber 30*a* of the sensor cylinder 3 IB via the second bypass conduit 34B. And the pressurized hydraulic fluid which has flowed into the sensor cylinder 31B drives the piston 30 of the sensor cylinder 3 IB forward, and at the same time the stop portion 29*c* at its end is removed from the switch section 32B and the microswitch goes into the OFF state. Moreover, a high surge pressure is generated immediately before the piston 10 of the main cylinder 11 arrives at the end of its stroke, and the pressure within the synchronizing cylinder 16B also abruptly rises.

Figure 2:
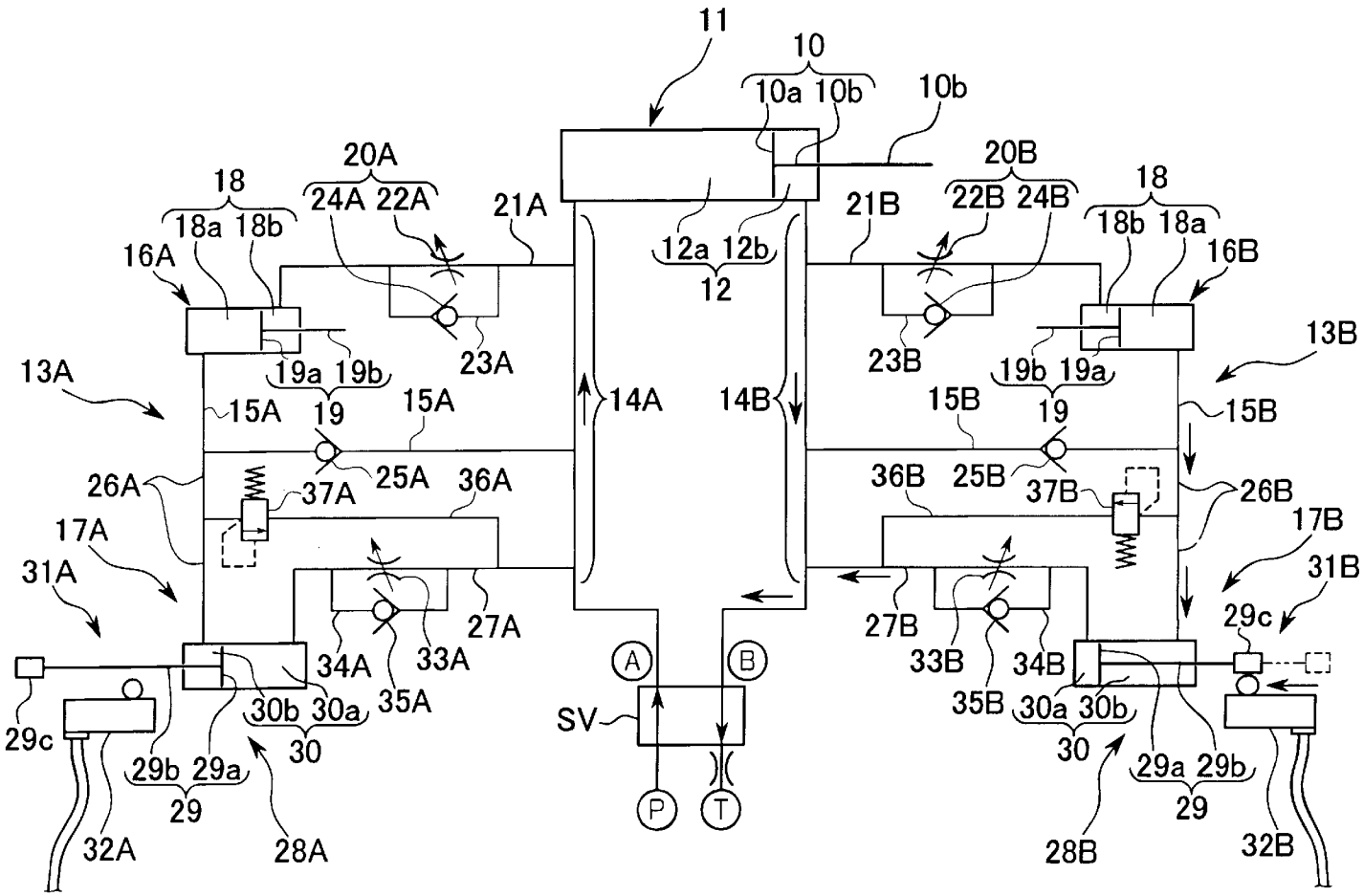
FIG. 2 is a circuit diagram of the sensor for cylinder control and the cylinder device which incorporates the same according to the first preferred embodiment of the present invention, showing the circuit state at the instant that the piston has completed its forward motion.

Furthermore, as shown in FIG. 2, at the instant that the piston 10 has arrived at the end of its stroke, the pressure of the hydraulic fluid in the rod side chamber 12*b* of the main cylinder 11 abruptly drops, and also the pressure which is supplied to the synchronizing cylinder 16B from the first connecting conduit 15B via the supply and drain conduit 14B abruptly drops because the supply of the pressure by the pump P, via main cylinder 11, is stopped, the flow of hydraulic fluid into conduit 14B stops, and the fluid in conduit 14B drains to tank. At this time, a pressure differential is generated between the synchronizing cylinder 16B which is in a high pressure state and the first connecting conduit 15B (between the second non-return valve 25B and the supply and drain conduit 15B) in which the pressure has abruptly dropped. Due to this pressure differential, the stop signal generation mechanism 17B of the second sensor for cylinder control 13B operates, and the driving of the main cylinder 11 is stopped.

In other words, since the second non-return valve 25B is present in the first connecting conduit 15B, its portion between the synchronizing cylinder 16B and the second non-return valve 25B goes into the high pressure state. On the other hand, the pressure in the first branch conduit 26B which is connected to this portion becomes higher than the pressure in the second branch conduit 27B which is connected to the supply and drain conduit 14B in which the pressure has abruptly dropped.

Due to this, hydraulic fluid flows suddenly from the synchronizing cylinder 16B on the high pressure side via the first branch conduit 26B into the rod side chamber 30*b* of the sensor cylinder 31B. At this time, the piston 29 of the sensor cylinder 31B is retracted due to the hydraulic fluid which has flowed into the rod side chamber 30*b*, and the stop portion 29*c* at its tip end comes into contact with the switch section 32B and the micro switch goes into the ON state.

When the switch section 32B goes into the ON state, a drive stop signal for the main cylinder 11 is despatched from the switch section 32B to the control board 38, and, along with indicating this fact upon a display device which is provided upon the control board 38, the changeover valve SV is changed over from its flow position to its neutral position. Accordingly the supply of pressurized hydraulic fluid from the port A of the changeover valve SV is stopped, and thereby the driving of the main cylinder 11 is stopped.

{Return of the Piston }

Figure 3:
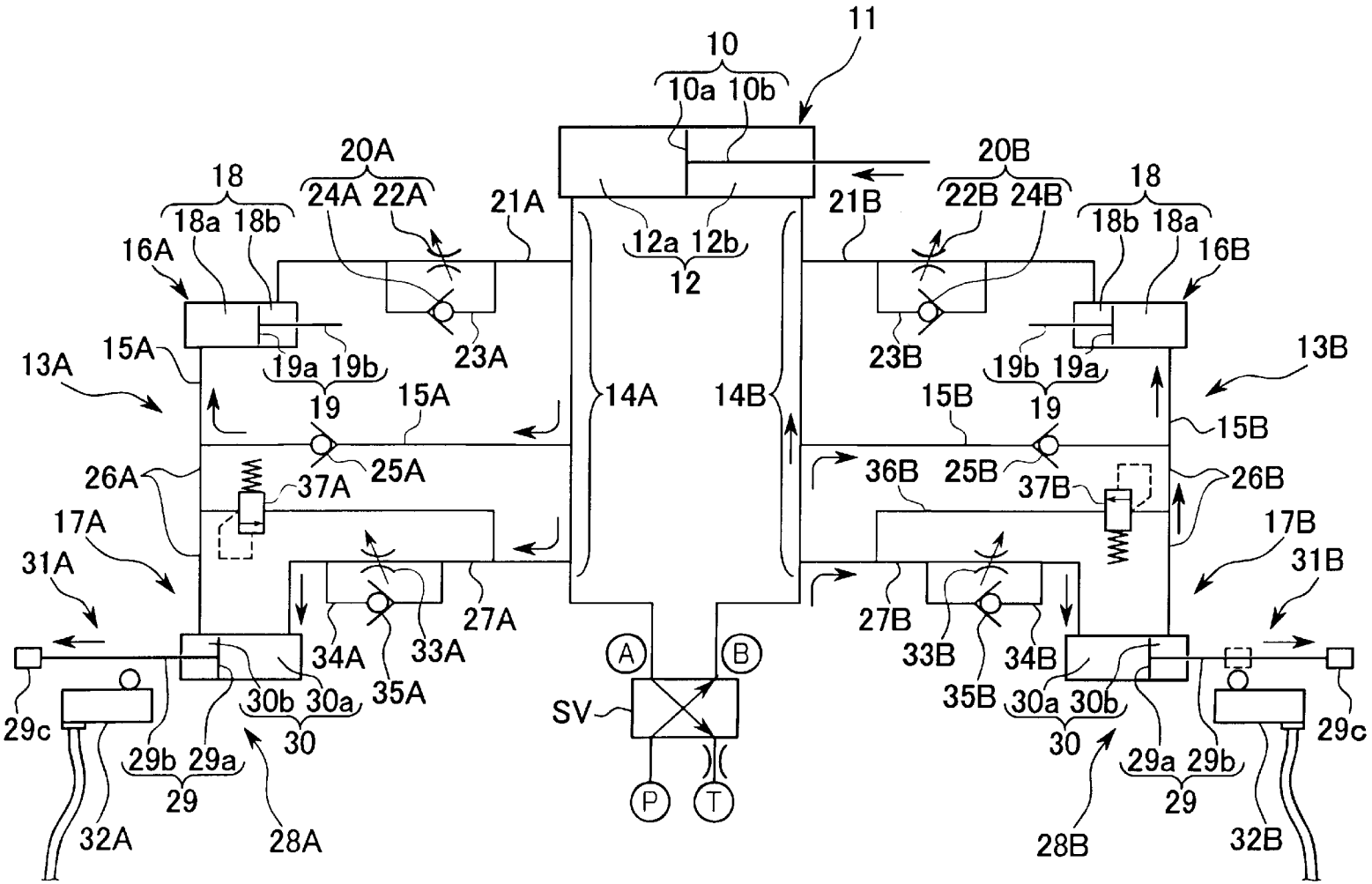
FIG. 3 is a circuit diagram of the sensor for cylinder control and the cylinder device which incorporates the same according to the first preferred embodiment of the present invention, showing the circuit state at the instant that the piston commences its return motion.
Figure 4:
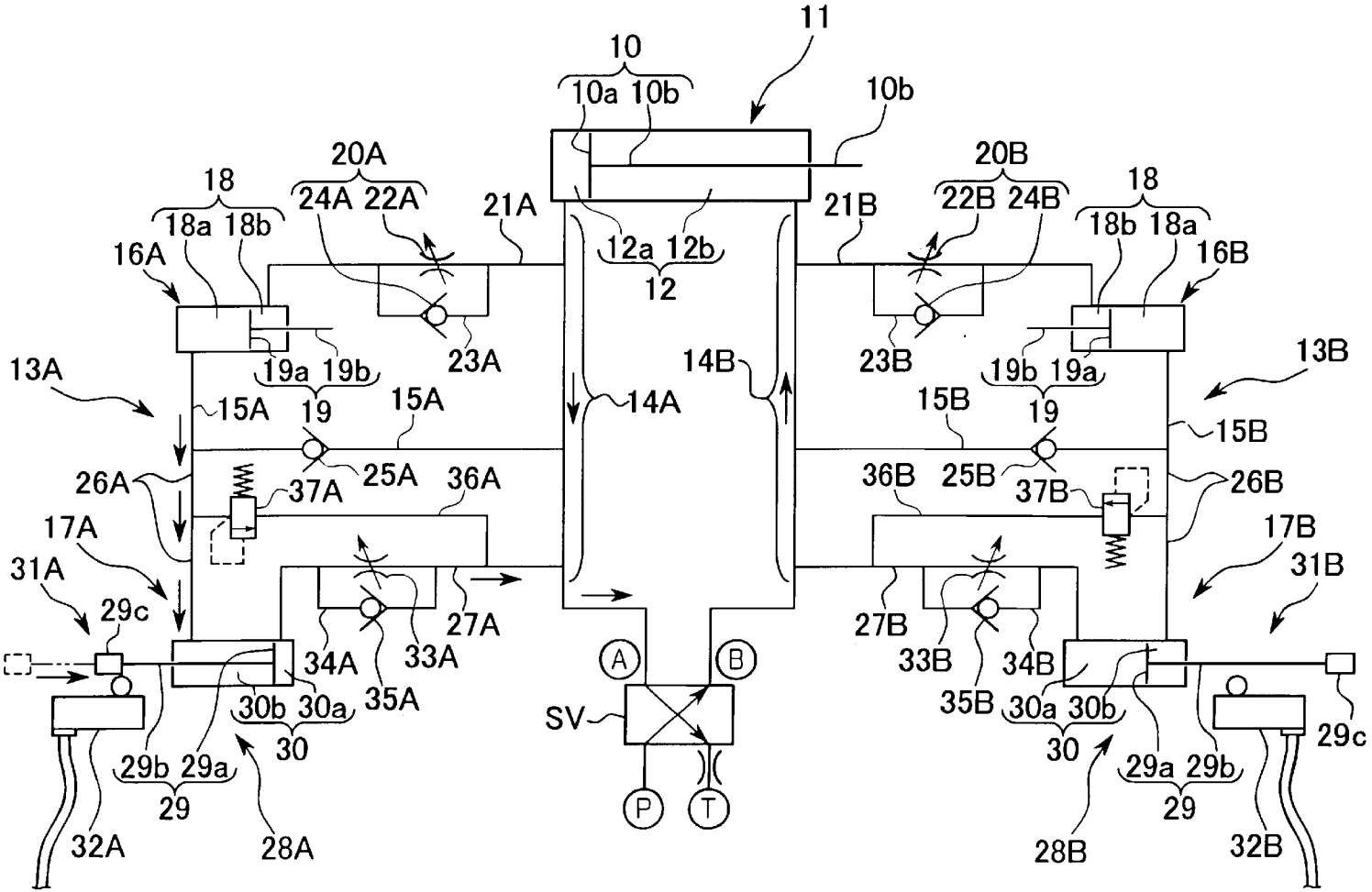
FIG. 4 is a circuit diagram of the sensor for cylinder control and the cylinder device which incorporates the same according to the first preferred embodiment of the present invention, showing the circuit state at the instant that the piston has completed its return motion.

Now, when the piston 10 of the main cylinder 11 is to be returned, the manner in which the operational states of the first sensor for cylinder control 13A and the second sensor for cylinder control 13B are reversed from their states in the case of advancing the piston 10 will be explained simply in the following with reference to FIGS. 3 and 4 That is, when returning the piston 10, first, along with connecting together the port B and the pump P via the changeover valve SV, switching over of the connections is also performed so as to connect together the port B and the tank T, and pressurized hydraulic fluid from the pump P is supplied via the supply and drain conduit 14B to the rod side chamber 12*b* of the main cylinder 11.

At this time, the operations of the first sensor for cylinder control 13A and the second sensor for cylinder control 13B are mutually reversed by contrast to the case described above when the piston is being advanced forward, and when the piston starts to be returned the switch section 32B is turned into the OFF state by the sensor cylinder 31B of the second sensor for cylinder control 13B, and, when the returning of the piston has been completed, the switch section 32A is turned into the ON state by the stop signal generation mechanism 17A of the first sensor for cylinder control 13A, and the driving of the main cylinder 11 is thereby stopped.

Since in this manner, in this first preferred embodiment of the present invention, there are included the stop signal generation mechanisms 17A and 17B which generate the signals which causes stopping of the driving of the main cylinder 11 due to the pressure differentials between the synchronizing cylinders 16A and 16B and the first connecting conduits 15A and 15B generated at the instant that the additional pressure from the head side chamber 12*a* or the rod side chamber 12*b* of the main cylinder 11 is stopped, thereby a stop signal is generated by the pressure differential that is generated at the instant that the piston 10 arrives at the end of its stroke, and it is possible to stop the driving of the main cylinder 11 reliably and at high speed.

Furthermore since, along with connecting together the rod side chambers 30*b* of the sensor cylinders 31A and 31B and the interiors of the first branch conduits 26A and 26B, also the head side chambers 30*a* of the sensor cylinders 31A and 31B and the interiors of the second branch conduits 27A and 27B are connected together, thereby the switches 32A and 32B operate mechanically when the pressures in the first branch conduits 26A and 26B become higher than the pressures in the second branch conduits 27A and 27B, and it becomes possible to generate a stop signal, so that it is possible to operate reliably with a simple and cheap structure.

Yet further, since using the load mechanisms 20A and 20B the synchronizing cylinders 16A and 16B whose internal chamber volumes can increase are made to function as accumulators, it is possible to ensure sufficient pressure differential and volume of hydraulic fluid to generate the signals. Furthermore, since the first and second sensors for cylinder control 13A and 13B of this first preferred embodiment are implemented as integrated valves which are provided on the side of the changeover valve SV, thereby as a whole it is possible to make the device compact, and moreover a low cost for the system can be anticipated.

Next, the method of detecting erroneous operation when the cylinder device of this first preferred embodiment has stopped at an intermediate point due to so called flash will be explained.

With this first preferred embodiment, in the case of normal operation, as shown in FIGS. 6 and 7, in the state (the "A" state in the figure) in which a sliding metal mold 40 which is attached at the end of the piston 10 of the main cylinder 11 is in contact with a metal mold main body 41, the switch section 32B of the second sensor for cylinder control 13B goes into the ON state, and the driving of the main cylinder 11 is stopped, but even in the case that the operation of said main cylinder 11 !! is undesirably stopped at an intermediate point due to the flash or burr (the "B" state in the figure), the switch section 32B of the sensor 13B for controlling the second cylinder goes into the ON state, and a drive stop signal for the main cylinder 11 is thereby despatched. Due to this, since trouble will undesirably occur if the system undergoes intermediate stoppage, with the cylinder device of this first preferred embodiment, erroneous operation is detected by the timer 38*a* if the system goes into the intermediate stoppage state, and a signal is generated which informs the operator that an error has occurred.

In other words, when the system goes into its state with the piston 10 of the main cylinder 11 having completely returned (the "C" state in the figure), the piston 29 of the sensor cylinder 31A of the first sensor for cylinder control 13A comes into contact with the switch section 32A which goes into the ON state, and the driving of the main cylinder 11 is stopped by the stop signal. When from this state hydraulic fluid is supplied and the cylinder 11 is driven, the above described piston 11 is removed away from the switch section 32A which goes into the OFF state, and from this time point the timer 38*a* operates, and the timer count starts.

And, if the system has stopped at an intermediate point, the piston 29 of the sensor cylinder 31B of the second sensor for cylinder control 13B comes into contact with the switch section 32B which goes into the ON state, and, along with the count of the timer 38*a* stopping, if the operating time period during this interval is shorter than a normal operating time period which is set in advance, for example if the normal operating time period is 30 seconds and the actual operating time period is 28 seconds, then the timer 38*a* decides that erroneous operation has occurred and generates an error signal, so that a buzzer or a lamp is operated in order to inform the operator of the error. By doing this it is possible to avoid the trouble that would occur if the intermediate stoppage could not be detected.

Next a second preferred embodiment of the sensor for cylinder control and of a cylinder device which incorporates it according to the present invention will be explained with reference to FIG. 8.

Figure 8:
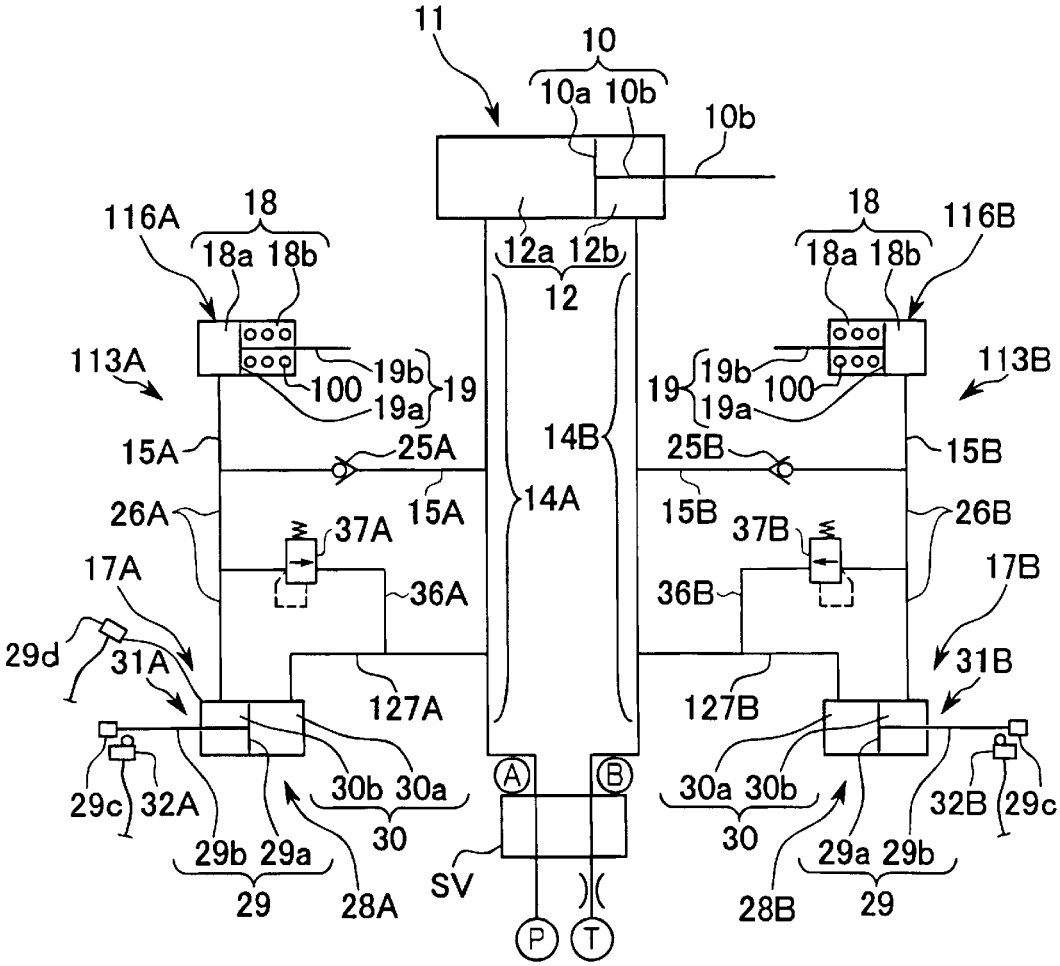
FIG. 8 is a circuit diagram showing a sensor for cylinder control and a cylinder device which incorporates the same according to a second preferred embodiment of the present invention.

The point in which the second preferred embodiment differs from the first, is that, while in the first preferred embodiment the second connecting conduits 21A and 21B and the load mechanisms 20A and 20B were provided and also the second bypass conduits 34A and 34B were provided in the second branch conduits 27A and 27B, by contrast in this second preferred embodiment, in the first and second sensors for cylinder control 113A and 113B, as shown in FIG. 8, not only are no second connecting conduits or load mechanisms provided, but also no second bypass conduits are provided in the second branch conduits 127A and 127B.

In other words, in this second preferred embodiment, instead of a load mechanism like that in the first preferred embodiment, springs 100 are housed within the synchronizing cylinders 116A and 116B, and thereby when load is applied it is possible for a pressure differential to be generated by the biasing actions of the springs 100. Furthermore, in this second preferred embodiment, the second bypass conduits for preventing reverse flow are eliminated, and accordingly the conduit structure is simplified. Moreover, although the synchronizing cylinders 116A and 116B are made to be single acting cylinders by the insertion of the springs 100, they could also function as return action cylinders.

Next a third preferred embodiment of the sensor for cylinder control and of a cylinder device which incorporates it according to the present invention will be explained with reference to FIG. 9.

Figure 9:
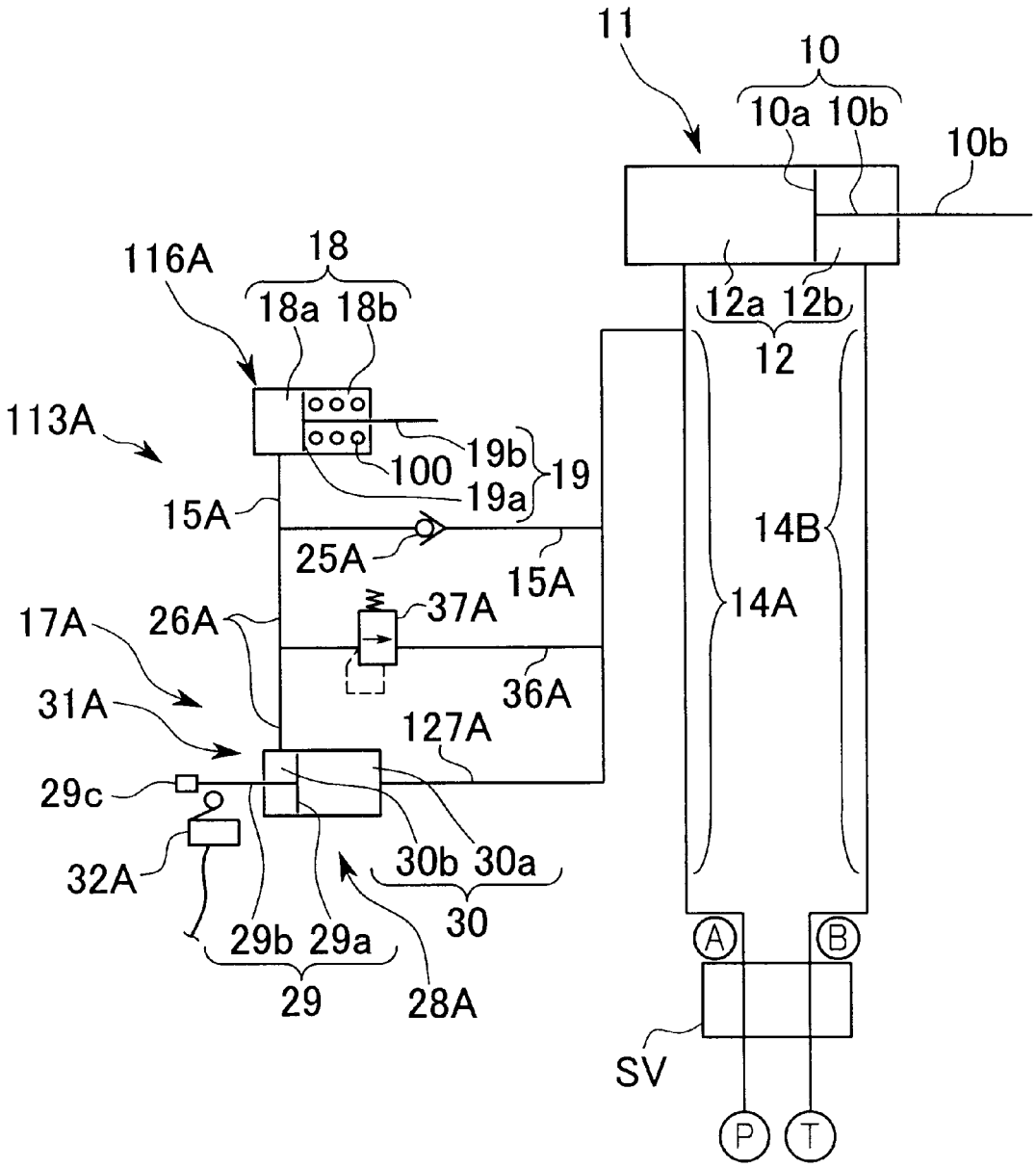
FIG. 9 is a circuit diagram showing a sensor for cylinder control and a cylinder device which incorporates the same according to a third preferred embodiment of the present invention.
Figure 10:
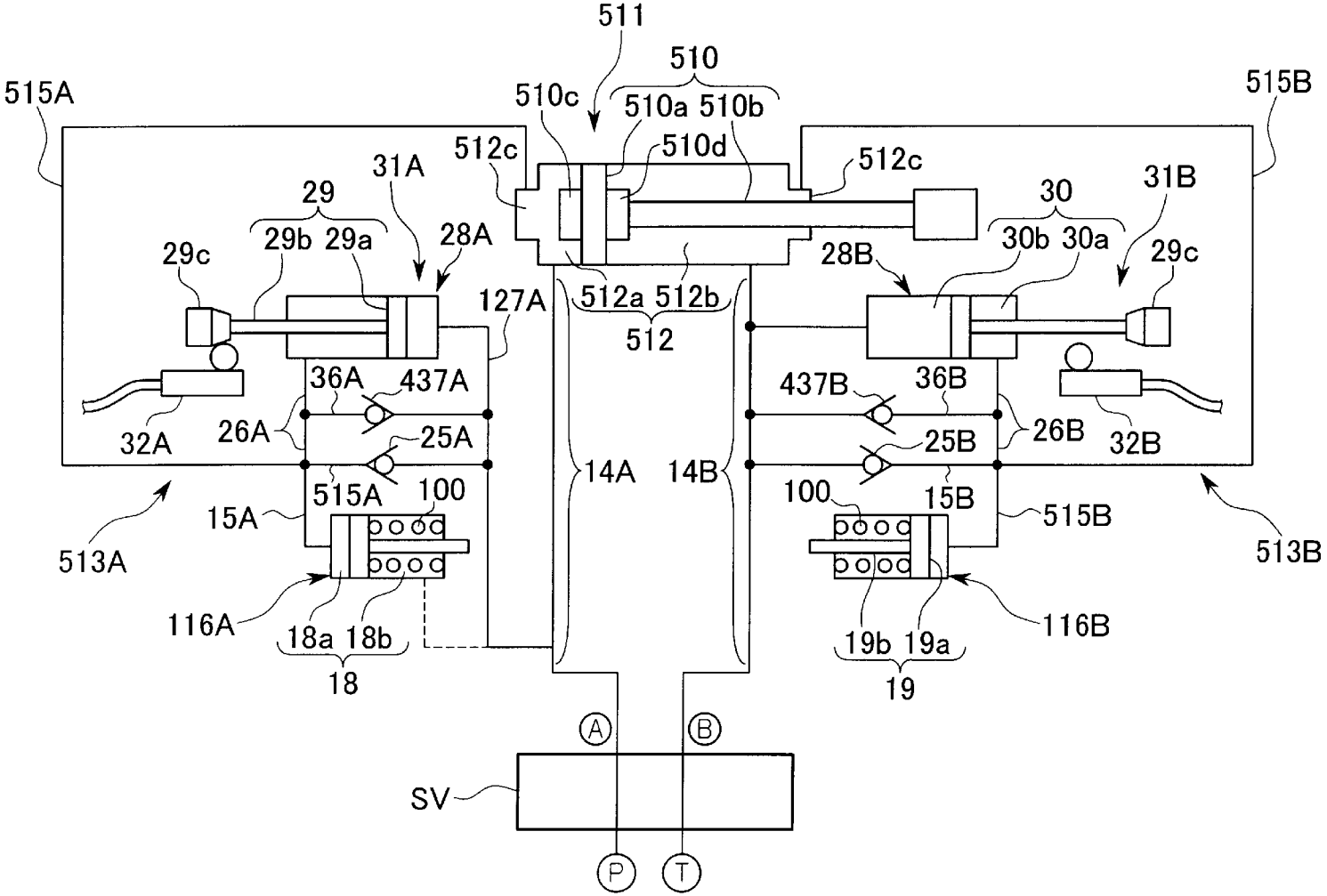
FIG. 10 is a circuit diagram showing a sensor for cylinder control and a cylinder device which incorporates the same according to a fourth preferred embodiment of the present invention.

The point in which this third preferred embodiment differs from the second preferred embodiment is that, by contrast to the second preferred embodiment in which the first and second sensors 13A and 13B for cylinder control were provided in the pair of supply and drain conduits 14A and 14B respectively, in this third preferred embodiment, as shown in FIG. 9, only the first sensor for cylinder control 113A is provided in the supply and drain conduit 14A. Furthermore, another point of difference is that in this third preferred embodiment the conduit of the first sensor for cylinder control 113A is a cul-de-sac, while in the second preferred embodiment described above it was an in-line type conduit.

In other words, with this third preferred embodiment, single-sided control is performed with the first sensor for cylinder control 113A, and moreover there is the beneficial point that, since the first connecting conduit 15A, the third branch conduit 36A, and the second branch conduit 127A are connected to the supply and drain conduit 14A all together as one, therefore attachment and detachment of the first sensor for cylinder control 113A are facilitated.

Next a fourth preferred embodiment of the sensor for cylinder control and of a cylinder device which incorporates it according to the present invention will be explained with reference to FIG. 9.

With this fourth preferred embodiment, the technique and the assembly structure described in Japanese Patent Publication No. Heisei 6-50304 are employed. In other words, with this fourth preferred embodiment, as shown in FG. 10, along with providing insertion apertures 512*c* and 512*d* in the cylinder chambers 512 (the head side chamber 512*a* and the rod side chamber 512*b*) of the main cylinder 511, insertion portions 510*c* and 510*d* which can be inserted into these insertion apertures 512*c* and 512*d* are provided upon the piston 510, and, along with connecting the supply and drain conduits 14A and 14B to the cylinder chambers outside the insertion apertures 512*c* and 512*d*, the first connection conduits 515A and 515B of the sensors for cylinder control 513A and 513B are respectively connected within the insertion apertures 512*c* and 512*d*.

By doing this, when the insertion portions 510*c* and 510*d* are intercepting the chambers of the insertion apertures 512*c* and 512*d* and the supply and drain conduits 14A and 14B, since hydraulic fluid is expelled into the first connecting conduits 515A and 515B, even if the piston 510 of the main cylinder 511 is stopped partway along its travel by seizing the flash or the burr, no erroneous operation of the sensors for cylinder control 513A and 513B occurs, and it is possible for the sensors for cylinder control 513A and 513B to be operated reliably only in the end-of-stroke state when the insertion portions 510*c* and 510*d* enter into the insertion apertures 512*c* and 512*d*.

It should be noted that in this fourth preferred embodiment there is the point of difference from the first preferred embodiment, that non-return valves 437A and 437B are used instead of the relief valves 37A and 37B.

Figure 11:
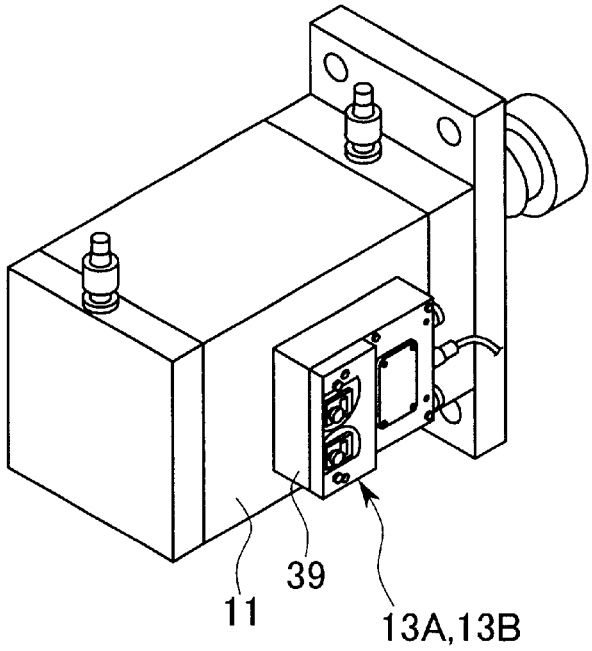
FIG. 11 is a perspective view showing another example of arrangement of the sensor for cylinder control, in the first preferred embodiment of the sensor for cylinder control and the cylinder device which incorporates the same according to the present invention.
Figure 12:
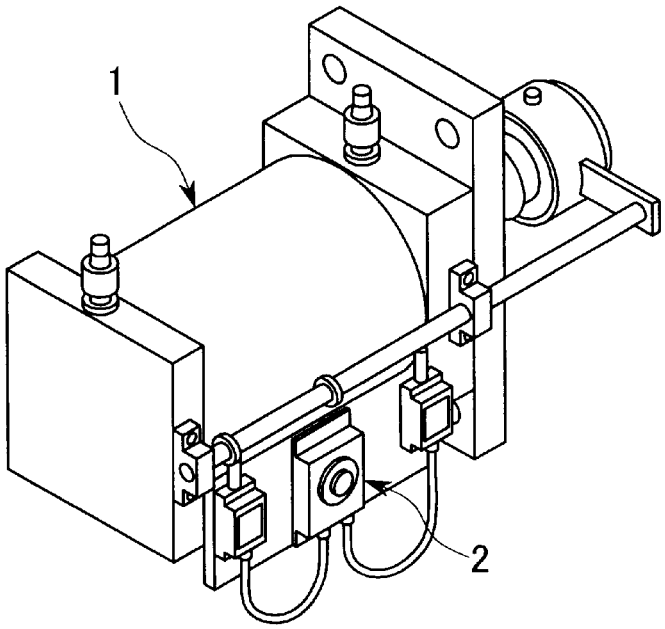
FIG. 12 is a perspective view showing an example of a prior art sensor for cylinder control and a cylinder device according to the present invention.

It should be understood that the technical scope of the present invention is not to be considered as being limited to the preferred embodiments disclosed above; various alterations and modifications are possible, provided that the essential concept of the present invention is not departed from. For example, although in the above described first preferred embodiment the first and second sensors for cylinder control 13A and 13B were positioned as separated from the main cylinder 11, it would also be possible, as a variation, to position them in direct contact with the main cylinder 11, as shown in FIG. 11. The position in which the sensor for cylinder control according to the present invention is disposed may, in this manner, be freely chosen, because it is compact.

Furthermore, although in the above described preferred embodiments switch sections which generated stop signals mechanically by shifting of the pistons 29 of the sensor cylinders 31A and 31B were utilized as the switch sections 32A and 32B, it would also be possible to employ an alternative construction, in which for example switch sections were utilized which generated stop signals electrically via pressure sensors which were operated by pressure which was generated by shifting of the pistons 29 of said sensor cylinders 31A and 31B, as schematically shown at 29*d* in FIG. 8.

Furthermore, although in the above disclosed preferred embodiments the first throttle valves 22A and 22B were provided as the load mechanisms 20A and 20B, as an alternative, it would also be possible to apply load to the synchronizing cylinders 16A and 16B by other types of mechanism. For example, it would be possible reliably to obtain a pressure differential by applying further load by springs or by compressed gas enclosed within the synchronizing cylinders, as in the second preferred embodiment disclosed above; and, if such cylinders with springs or compressed gas enclosed are utilized, it would be possible to omit the first throttle valves 22A and 22B. Yet further, instead of the synchronizing cylinders, it would be possible, as an alternative, to employ cylinders which generated additional pressure (booster cylinders or the like).

Moreover, a variant structure would also be possible in which the synchronizing cylinders 16A and 16B were not utilized, but instead other constructions which had the function of accumulators were employed. For example, if the synchronizing cylinders 16A and 16B are not provided, but large diameter conduits are employed whose internal diameters are greater than those of the first connecting conduits 15A and 15B, it would be possible for them to function in the same manner as accumulators.

Furthermore, other possible types of valves such as proportional valves, pilot check valves, throttle valves or the like may be used as the second non-return valves 25A and 25B, provided that they are valves which permit the flow of hydraulic fluid in one direction only, so that they can suppress the flow of fluid towards the main cylinder 11. Yet further, the relief valves 37A and 37B may alternatively be pressure valves such as sequence valves, counterbalance valves, or the like, and it would also be possible to construct the first connecting conduits 15A and 15B as combined with the third branch conduits 36A and 36B, provided that non-return valves such as pressure reduction valves (unload valves) or the like were incorporated therein. It should be noted that, even if orifices are employed instead of pressure valves or the like, it is possible to obtain pressure.

Yet further, if the synchronizing cylinders 16A and 16B and the sensor cylinders 31A and 31B are made more complex (such as by making their cylinders of the double rod type, or of the single sided complex type, or of the spool (rodless) type or the like), it is possible to simplify the conduit structure, and by doing this it is possible to anticipate a further benefit with regard to compactness.

Further, it would also be possible to form the sensor cylinders 31A and 31B as spools (rodless type), and to provide the function of the switch sections by housing them within the sensor cylinders. Yet further, it would also be acceptable to use ram cylinders or the like as the sensor cylinders, and to use springs or compressed gas as the shift suppression mechanisms which prevent the shifting of the pistons of the sensor cylinders against the resistance of the pressure in the first branch conduits 26A and 26B which is lower than the pressure when the above described pressure differential is generated. In this case, the second branch conduits 27A and 27B and the second throttle valves 33A and 33B and the third non-return valves 35A and 35B of the above described embodiments which constitute the flow controllers would become unnecessary.

By providing a shift suppression mechanism in this manner by using springs or compressed gas or the like as the shift suppression mechanisms which prevent the shifting of the pistons of the sensor cylinders against the resistance of the pressure in the first branch conduits 26A and 26B which is lower than the pressure when the above described pressure differential is generated, thereby, during the shifting of the piston 10 of the main cylinder 11, it is ensured by this shift suppression mechanism that the pistons of the sensor cylinders are not shifted, since the pressure in the first branch conduits 26A and 26B becomes a pressure which is lower than the pressure when the above described pressure differential is generated.

And, when the piston 10 of the main cylinder 1 arrives at the end of its stroke, along with the generation of the above described pressure differential, since fluid flow on the upstream sides of the second non-return valves 25A and 25B into the first connection conduits 15A and 15B is suppressed, accordingly the pressure in the first branch conduits 26A and 26B suddenly rises and surpasses the pressure which can be suppressed by the shift suppression mechanism, so that the piston of the sensor cylinder shifts and the above described signal is generated by the switch sections 32A and 32B.

Furthermore, although with the above described preferred embodiments the single main cylinder 11 was controlled with the first and second sensors 13A and 13B for cylinder control, as an alternative, it would also be possible, by branching the first connecting conduit of such a sensor for cylinder control and connecting it to a plurality of main cylinders, to control, for example a plurality of main cylinders which had different outputs by a single sensor for cylinder control.

Yet further, although the timer 38*a* was provided upon the control board 38 which was fitted in the case 39 which housed the first and second sensors for cylinder control 13A and 13B, it would also be possible to provide the sensors for cylinder control or the control board in a separated position. Moreover, it would also be possible to provide the first and second sensors for cylinder control 13A and 13B in positions remote from the control board 38.

According to the present invention, the following benefits are provided. According to the sensor for cylinder control and the cylinder device of the present invention, there are comprised an accumulator which is connected via a connecting conduit to one of two chambers of a main cylinder and whose interior is pressurized by fluid expelled from said one chamber, and a stop signal generation mechanism which generates a signal which stops the driving of said main cylinder due to pressure differential between said accumulator and said connecting conduit which is generated at the instant that the increase of pressure from said one chamber stops; and thereby the stop signal is generated by the pressure differential which is generated at the instant that the piston arrives at the end of its stroke, and accordingly it is possible to stop the driving of the main cylinder reliably and moreover at high speed.

Accordingly, with the present invention, the sensor for cylinder control can be connected by the connecting conduit to the main cylinder while being located remote therefrom, i.e. remote from the actual workplace; and therefore, along with preventing the occurrence of erroneous operation, the necessity for provision of high cost switching equipment and for switch maintenance and replacement is avoided. Furthermore, since pressure differential which is generated by the effects of the accumulator is utilized, in the case of a general purpose cylinder, adjustments due to the size of the cylinder and so on, and hydraulic fluid amount adjustments, are almost completely unnecessary, and it becomes possible to connect directly to the control board etc., and also to control a plurality of cylinders which have different outputs. Due to this, according to the present invention, it is possible to anticipate better uniformity in the quality of the goods produced, enhanced production efficiencies and safety, and moreover reduction of cost.

This invention may be embodied in other forms or carried out in other ways without departing from the spirit thereof. The present embodiments are therefore to be considered in all respects illustrative and not limiting, the scope of the invention being indicated by the appended claims, and all modifications falling within the meaning and range of equivalency are intended to be embraced therein.

What is claimed is:

1. A sensor device for cylinder control which is connected to a main cylinder having an internal cylinder chamber which is partitioned by a piston into two chambers, and which detects the operational state of said piston, comprising:

an accumulator which is connected via a connecting conduit to one of said two chambers and whose interior is pressurized by fluid expelled from said one chamber; and a stop signal generation mechanism which generates a signal which stops the driving of said main cylinder due to pressure differential between said accumulator and said connecting conduit which is generated at the instant that the increase of pressure from said one chamber stops.

2. A sensor device according to claim 1, wherein said stop signal generation mechanism comprises:

a non-return valve provided in said connecting conduit which suppresses flow of fluid towards said one chamber;

a first branch conduit of which a one end is connected to said connecting conduit between said accumulator and said non-return valve;

a second branch conduit of which a one end is connected to said connecting conduit between said one chamber and said non-return valve; and a switch mechanism which is connected to the other end of said first branch conduit and to the other end of said second branch conduit and which generates said signal when the pressure in said first branch conduit becomes higher than the pressure in said second branch conduit.

3. A sensor device according to claim 2, wherein said switch mechanism further comprises:

a sensor cylinder which comprises a cylinder chamber which is partitioned by a piston into two chambers; and a switch section which generates said signal mechanically by the shifting of said piston of said sensor cylinder or electrically by a pressure sensor, and one of said chambers of said sensor cylinder is connected with the interior of said first branch conduit, while the other of said chambers of said sensor cylinder is connected with the interior of said second branch conduit.

4. A sensor device according to claim 1, wherein said stop signal generation mechanism comprises:

a non-return valve provided in said connecting conduit which suppresses flow of fluid towards said one chamber;

a first branch conduit whose one end is connected to said connecting conduit between said accumulator and said non-return valve;

a sensor cylinder which is connected to the other end of said first branch conduit and which comprises a piston which can be shifted by fluid which flows in from said first branch conduit;

a switch section which generates said signal mechanically by shifting of said piston of said sensor cylinder or electrically by a pressure sensor; and a shift suppression mechanism which suppresses shifting of said piston of said sensor cylinder opposing the pressure in said first branch conduit which is lower than the pressure when said pressure differential is generated.

5. A sensor device according to claim 1, further characterized in that said accumulator is a synchronizing cylinder comprising a piston which can be shifted by fluid which flows in from said connecting conduit, and by comprising a load mechanism which applies load to said piston of said synchronizing cylinder to shift it, when fluid flows in from said connecting conduit.

6. A sensor device according to claim 1, wherein said accumulator is a large diameter conduit whose internal diameter is set to be larger than that of said connecting conduit.

7. A sensor device according to claim 1, wherein said stop signal generation mechanism comprises an erroneous operation detection mechanism which sets in advance as a normal operating time period the time period until said piston of said main cylinder arrives at the end of its stroke during normal operation and said stop signal is generated, and generates a signal indicative of erroneous operation, when said stop signal for said driving of said main cylinder is generated in a time period which is shorter than said normal operating time period.

8. A cylinder device comprising:

a main cylinder comprising an internal cylinder chamber which is partitioned by a piston into two chambers, a sensor for cylinder control which is connected to the main cylinder, and which detects the operational state of said piston, the sensor including:

an accumulator which is connected via a connecting conduit to one of said two chambers and whose interior is pressurized by fluid expelled from said one chamber; and a stop signal generation mechanism which generates a signal which stops the driving of said main cylinder due to pressure differential between said accumulator and said connecting conduit which is generated at the instant that the increase of pressure from said one chamber stops; and further comprising:

a pair of supply and drain conduits of which the one ends are connected to said two chambers of said main by cylinder and which supply and drain fluid thereto and therefrom; and a changeover valve which is connected to the other ends of said pair of supply and drain conduits, and wherein said sensor for cylinder control is provided so as to connect said connecting conduit to at least one of said pair of supply and drain conduits.

9. A cylinder device according to claim 8, further characterized in that said sensor for cylinder control is disposed at said changeover valve.

10. A cylinder device according to claim 8, wherein a plurality of said main cylinders are provided, and said sensor for cylinder control is connected so that said connecting conduit branches to said plurality of main cylinders.

* * * * *